US012649634B2

(12) United States Patent
Olivier et al.

(10) Patent No.: US 12,649,634 B2
(45) Date of Patent: Jun. 9, 2026

(54) CARD FEEDER FOR A CARD PROCESSING MACHINE

(71) Applicant: Evolis SAS, Beaucouze (FR)

(72) Inventors: Serge Olivier, Briollay (FR); Benoit Letard, Bellevigne-en Layon (FR); Yves Liatard, Nantes (FR)

(73) Assignee: Evolis SAS, Beaucouze (FR)

( * ) Notice: Subject to any disclaimer, the term of this patent is extended or adjusted under 35 U.S.C. 154(b) by 51 days.

(21) Appl. No.: 18/739,512

(22) Filed: Jun. 11, 2024

(65) Prior Publication Data

US 2025/0019189 A1 Jan. 16, 2025

(30) Foreign Application Priority Data

Jul. 10, 2023 (FR) ..... 2307375

(51) Int. Cl.

| | |
|---|---|
| ***B65H 3/06*** | (2006.01) |
| ***B65H 1/06*** | (2006.01) |
| ***B65H 1/10*** | (2006.01) |
| ***B65H 3/54*** | (2006.01) |

(52) U.S. Cl.

CPC ..... *B65H 3/063* (2013.01); *B65H 1/06* (2013.01); *B65H 1/10* (2013.01); *B65H 3/0661* (2013.01); *B65H 3/54* (2013.01); *B65H 2301/4223* (2013.01); *B65H 2402/441* (2013.01); *B65H 2402/45* (2013.01);

(Continued)

(58) Field of Classification Search

CPC . B65H 1/06; B65H 1/10; B65H 3/063; B65H 3/0661; B65H 3/34; B65H 3/54; B65H 2301/4223; B65H 2402/441; B65H 2402/45; B65H 2405/11152; B65H 2405/115; B65H 2405/12; B65H 2701/1914

See application file for complete search history.

(56) References Cited

U.S. PATENT DOCUMENTS

| | | | |
|---|---|---|---|
| 3,948,506 A | 4/1976 | Crimmins et al. | |
| 10,377,591 B2 * | 8/2019 | Maynard | B65H 3/063 |

(Continued)

FOREIGN PATENT DOCUMENTS

| | | |
|---|---|---|
| EP | 2125383 | 5/2012 |
| EP | 3656711 | 5/2020 |

OTHER PUBLICATIONS

"European Application Serial No. 24186956.9, Extended European Search Report mailed Nov. 15, 2024", 8 pgs.

(Continued)

*Primary Examiner* — Prasad V Gokhale

(74) *Attorney, Agent, or Firm* — Schwegman Lundberg & Woessner, P.A.

(57) ABSTRACT

A card feeder including a frame, a reservoir receiving a stack of cards, a separation system including a separation roll, a ballast movable on the frame between a support position on the top of the stack and a stowed position on one side of the stack, a door movable on the frame between an open position and a closed position, a transmission system for moving the ballast from the support position into the stowed position when the door passes from the closed position into the open position, and a return system arranged so as to return the ballast back to the support position when it is in the stowed position.

5 Claims, 6 Drawing Sheets

(52) U.S. Cl.
CPC ..... *B65H 2405/11152* (2013.01); *B65H 2405/115* (2013.01); *B65H 2405/12* (2013.01); *B65H 2701/1914* (2013.01)

(56) References Cited

U.S. PATENT DOCUMENTS

2008/0217841 A1* 9/2008 Hoffman ..... B65H 3/54
271/165
2023/0322509 A1* 10/2023 Ando ..... B65H 3/48
271/90

OTHER PUBLICATIONS

"European Application Serial No. 24186956.9, Response filed Jan. 28, 2025 to Extended European Search Report mailed Nov. 15, 2024", 30 pgs.

* cited by examiner

[Fig. 1]
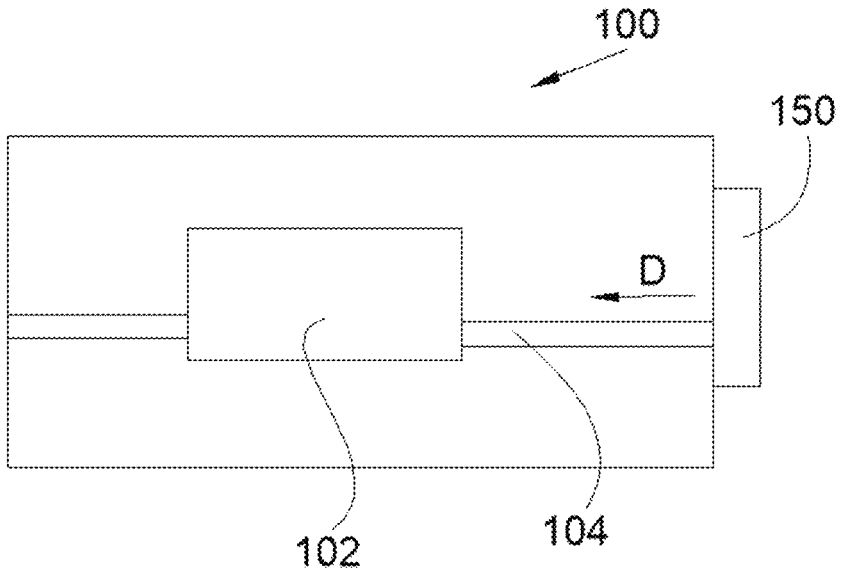

[Fig. 2]
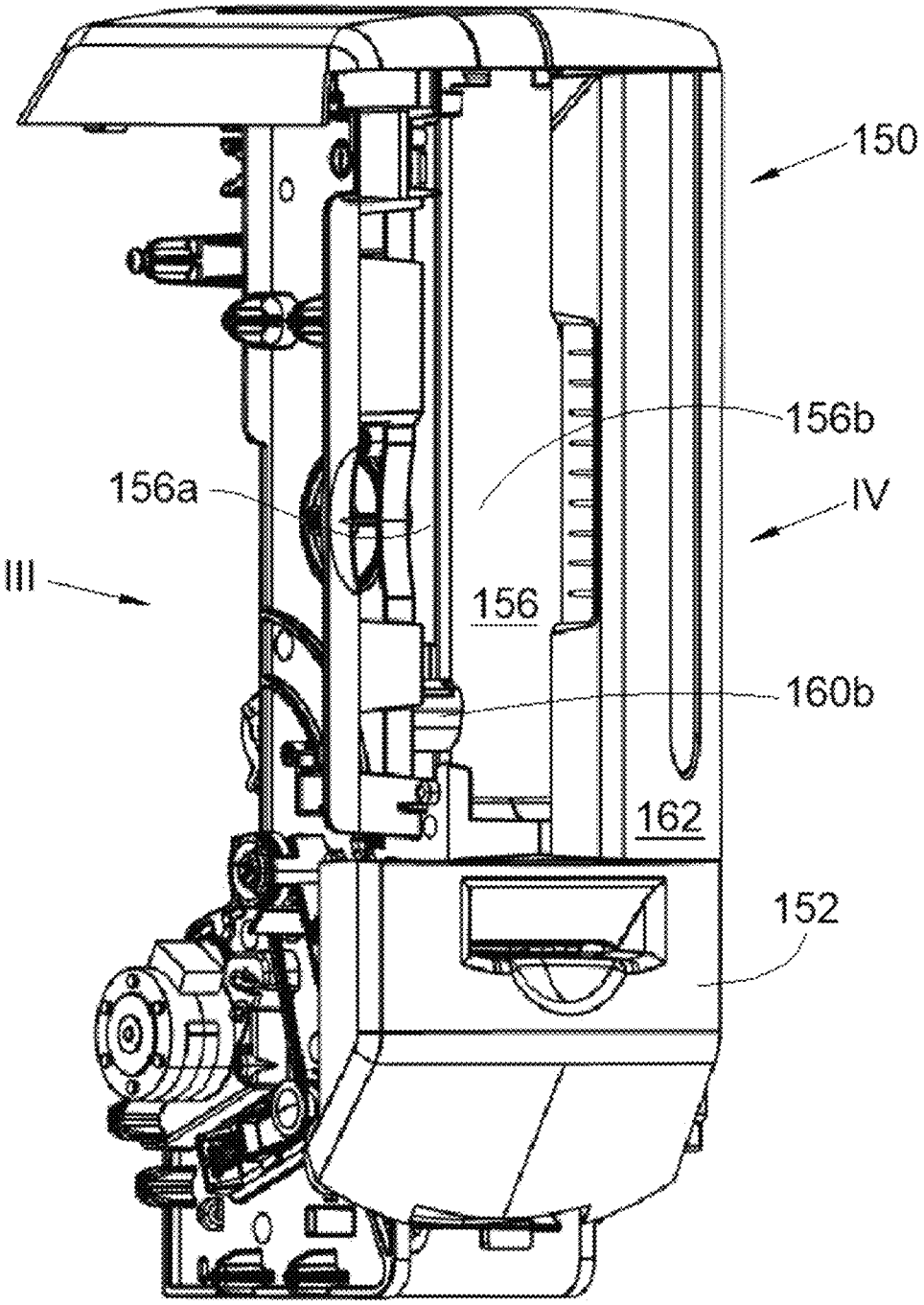

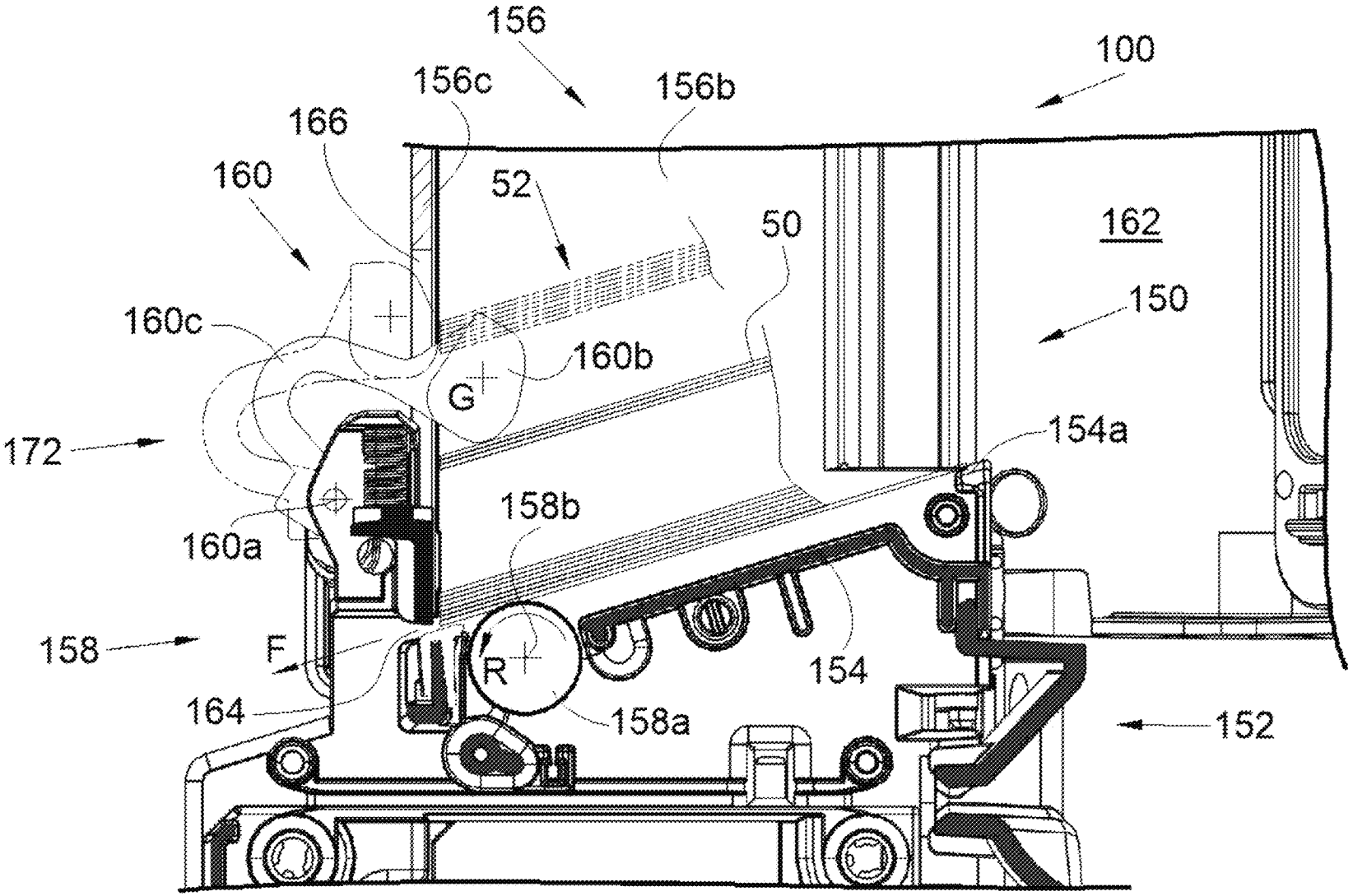
[Fig. 3]

[Fig. 4]
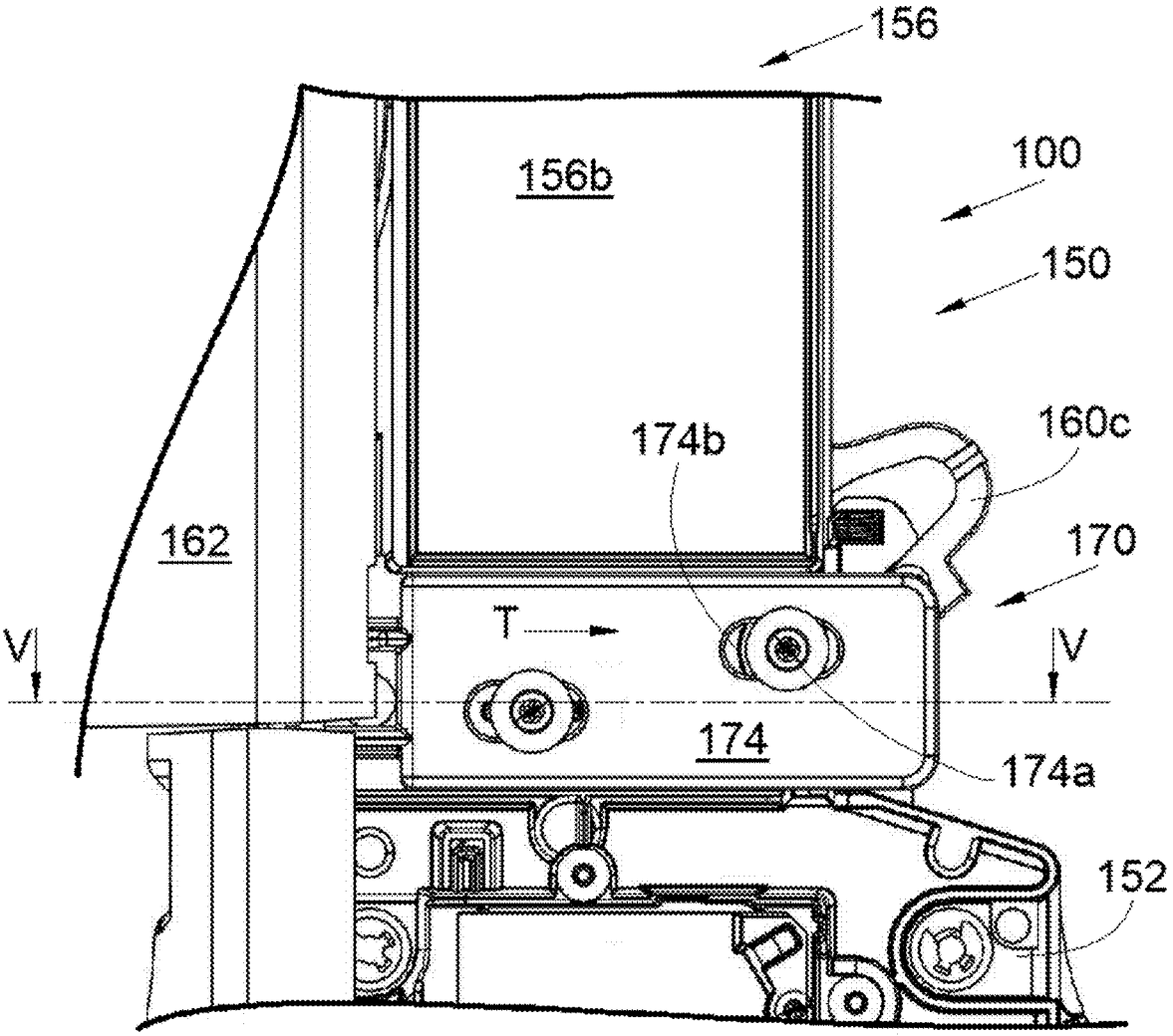

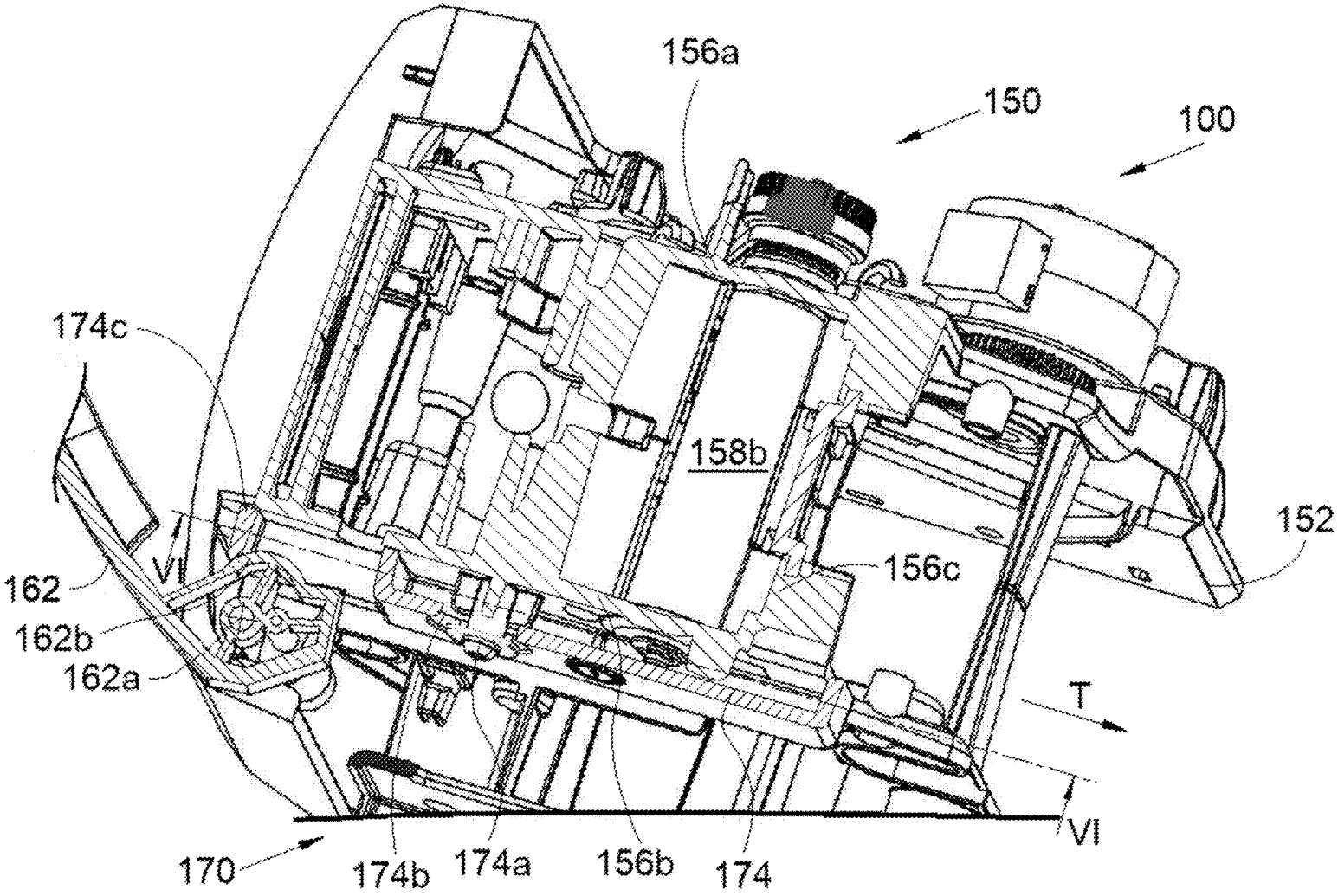
[Fig. 5]

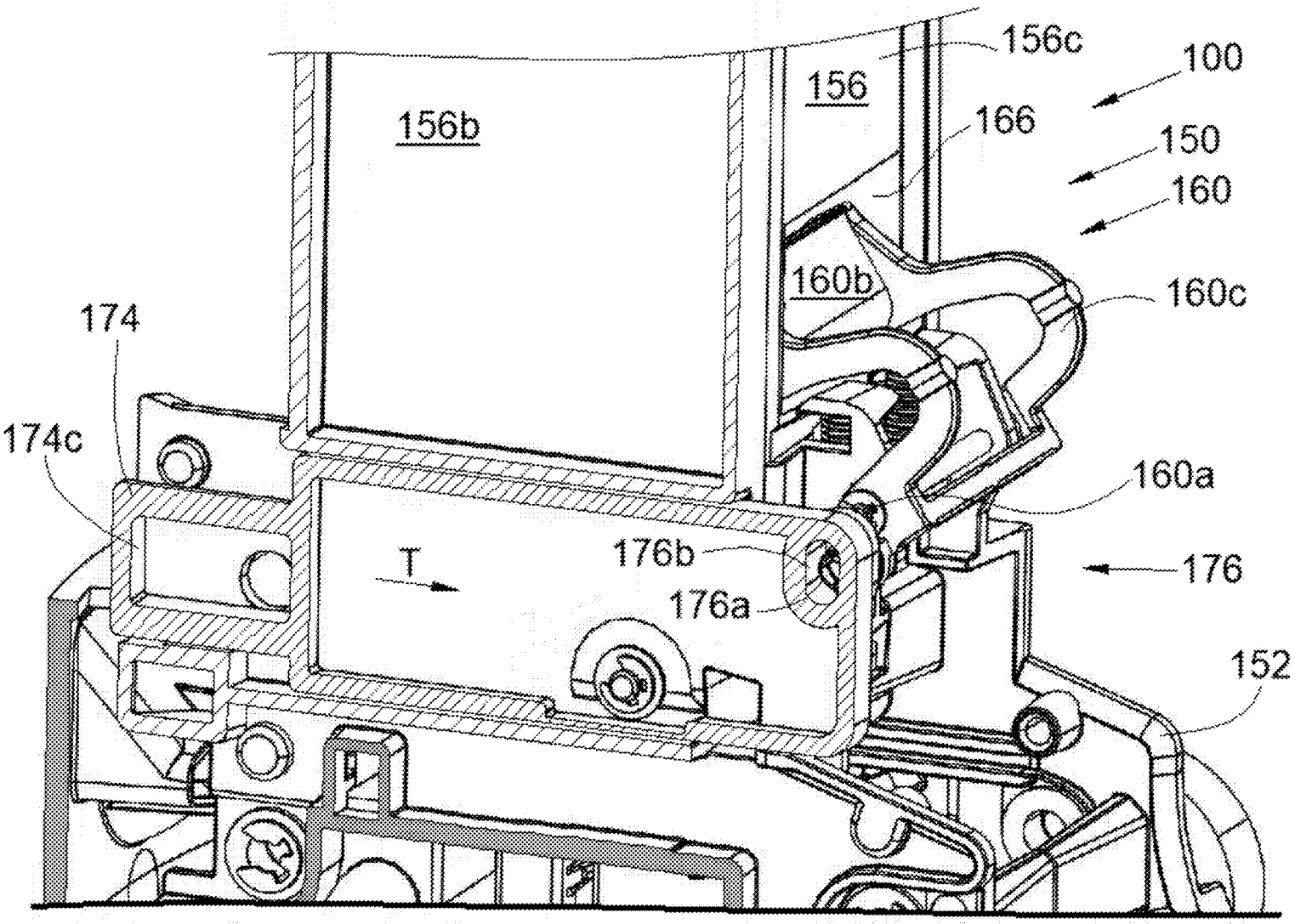
[Fig. 6]

CARD FEEDER FOR A CARD PROCESSING MACHINE

CROSS-REFERENCE TO RELATED APPLICATION(S)

This application claims priority to French Patent Appl. No. FR2307375, filed Jul. 10, 2023, which is incorporated herein by reference in its entirety.

TECHNICAL FIELD

The present invention relates to a card feeder for a card processing machine, as well as a processing machine including such a card feeder.

PRIOR ART

There are processing machines designed to process plastic cards, such as bank cards. Such a processing machine is, for example, a printer which prints a pattern on the card, or an encoding machine which encodes a chip on the card. For this purpose, the processing machine is equipped with a processing module which acts on the card.

To process such cards on a large scale, it is known to use a card feeder upstream of the processing module.

In general, such a card feeder includes a reservoir where the cards are stacked on top of one another and a separation system which picks the cards one after another while separating them. Different separation systems have been implemented, but they are not always satisfactory, and it is therefore necessary to find a card feeder with a different separation system.

DISCLOSURE OF THE INVENTION

An object of the present invention is to provide a card feeder for a card processing machine which has means for ensuring good support on a drive roll.

To this end, a card feeder for a processing machine is proposed, said card feeder including:

- a frame,
- a reservoir at the base of which a tray is arranged and, above the tray, a support intended to receive a stack of cards,
- a separation system including a separation roll arranged at the level of the tray and a drive system arranged so as to move the separation roll in rotation,
- a ballast movably mounted on the frame between a support position in which the ballast bears on the top of the stack and a stowed position in which the ballast is on one side of the stack,
- a door mounted movable on the frame between an open position enabling access to the reservoir and a closed position preventing access to the reservoir,
- a transmission system arranged so as to move the ballast from the support position into the stowed position when the door passes from the closed position into the open position, and
- a return system arranged so as to return the ballast back to the support position when it is in the stowed position.

Advantageously, the ballast is mounted movable in rotation about a tilting axis parallel to the axis of the separation roll, the tilting axis is arranged so that the center of gravity of the ballast is vertically above the tilting axis and horizontally between the tilting axis and the reservoir, when the ballast is in the stowed position, and the return system is gravity.

Advantageously, the transmission system includes:

- a cam secured to the door,
- a shaft secured to the ballast parallel to the tilting axis and offset with respect to the latter, and
- a slider mounted movable in translation on the frame parallel to a direction of translation and including a stop forming a follower element for the cam where the slider moves from a first position corresponding to a support position of the ballast into a second position corresponding to the stowed position of the ballast, when the cam moves from the closed position into the open position, and having a housing in which said shaft is accommodated, and where the housing is arranged so as to prevent any movement parallel to the direction of translation between the slider and the shaft, and enable movements perpendicular to the direction of translation between the slider and the shaft.

The invention also proposes a card processing machine including a card feeder according to one of the preceding variants, a processing module, and a transport system including means for moving the cards from the card feeder to the processing module.

BRIEF DESCRIPTION OF THE DRAWINGS

The above-mentioned features of the invention, as well as others, will appear more clearly upon reading the following description of one embodiment, said description being made with reference to the appended drawings, wherein:

FIG. 1 is a schematic illustration of a processing machine according to the invention;

FIG. 2 is a perspective and front view of a card feeder according to the invention;

FIG. 3 is a side view according to the arrow III and in section through a vertical plane of the card feeder of FIG. 2;

FIG. 4 is a side view according to the arrow IV of the card feeder of FIG. 2;

FIG. 5 is a top view in section according to the plane V-V of the card feeder of FIG. 4; and FIG. 6 is a sectional view of the card feeder of FIG. 5 by the plan VI-VI.

DETAILED DISCLOSURE OF SOME EMBODIMENTS

In the following description, the terms relating to a position are considered with reference to a processing machine 100 including a card feeder 150 according to the invention, where the processing machine 100 is in the position of use, i.e., as shown in FIG. 1.

The processing machine 100 includes a card feeder 150 according to the invention, a processing module 102, and a transport system 104 which includes means for moving the cards from the card feeder 150 to the processing module 102, where the means conventionally include rolls which pinch the cards and motors which drive the rolls in rotation. Thus, the processing module 102 is downstream of the card feeder 150 with respect to the direction of movement D of the cards by the transport system 104. For example, the processing module 102 is a printer or an encoding module, etc. The processing module 102 and the transport system 104 will not be described in more detail because they can take on any form known to a person skilled in the art.

FIGS. 2 to 6 show the card feeder 150 from different angles. The card feeder 150 includes a frame 152 which is secured to the frame of the processing machine 100. The frame 152 of the card feeder 150 may be a portion of the frame of the processing machine 100 or an attached and fixed element.

The card feeder 150 includes a reservoir 156 which is herein delimited by three vertical walls 156*a-c*, namely a back wall 156*c* and two lateral walls 156*a-b* arranged on either side of the back wall 156*c*. These vertical walls 156*a-c* are secured to the frame 152 and thus form, when viewed from above, a U-like shape, where the lateral walls 156*a-b* form the branches of the U-like shape and where the back wall 156*c* forms the bottom of the U-like shape.

In the lower part, the reservoir 156 has a tray 154 which forms the base of the reservoir 156 and above which a support 154*a* is provided which serves as a support for a stack 52 of cards 50, such as plastic cards, placed thereon. Thus, the stack 52 of cards 50 is formed by a vertical stack of cards 50 which are placed flat on top of one another and over the support 154*a*. Thus, the stack 52 of cards 50 is arranged between the vertical walls 156*a-c* and over the support 154*a*. The installation of the support 154*a* with a reduced surface area relative to the tray 154 allows minimizing the frictions of the cards 50 when they move.

The card feeder 150 also includes a door 162 which is movably mounted on the frame 152 and which forms the fourth wall of the reservoir 156. Thus, the door 162 is movably mounted on the frame 152 between an open position, enabling access to the inside of the reservoir 156 and the deposition of cards 50 on the support 154*a*, and a closed position, preventing access to the reservoir 156 while enclosing the cards 50 in the reservoir 156, and vice versa. Thus, the door 162 closes the U-like shape formed by the vertical walls 156*a-c*.

In the embodiment of the invention disclosed herein, the door 162 is movable in rotation about a door axis 162*a*, herein vertical.

In the lower portion of the reservoir 156, the card feeder 150 also includes a separation system 158 which is arranged so as to separate the cards 50 stored in the reservoir 156 from each other, while moving them successively through the bottom wall 156*c* according to a drive direction F which is then extended by direction of movement D.

The separation system 158 includes a separation roll 158*a* which is arranged at the level of the tray 154 according to a direction transverse to the drive direction F. The separation roll 158*a* is mounted movable in rotation on the frame 152 about its axis 158*b*. Thus, the cards 50 are in contact with the top of the separation roll 158*a* and the top of the support 154*a*.

The separation system 158 also includes a drive system, such as a motor, mounted on the frame 152, which is arranged so as to drive the separation roll 158*a* in rotation in the direction of the arrow R to drive the card 50 following the drive direction F. The processing machine 100 or the card feeder 150 includes a control unit arranged so as to control the drive system according to the needs.

Thus, the stack 52 of cards 50 rests on the separation roll 158*a* and the support 154*a*, and the separation is thus performed from below the stack 52, i.e., the separation roll 158*a* drives the card 50 which is the lowest, i.e., which rests on the separation roll 158*a* and the support 154*a*, to pull it out of the stack 52 and move it following the drive direction F through the bottom wall 156*c* through a window 164 that the bottom wall 156*c* has for this purpose.

Conventionally, the window 164 is sized in height to let only one card 50 pass through at a time.

The separation roll 158*a* drives the card 50 up to the transport system 104 which handles it to transfer it to the processing module 102 and expel it from the machine 100 after processing.

To assist in the separation of the cards 50 by the separation roll 158*a*, the support 154*a* is arranged so that the lowest card 50 has an orientation with a descending slope towards the separation roll 158*a*.

The card feeder 150 also includes a ballast 160 which is movably mounted on the frame 152 between a support position (continuous lines in FIG. 3) and a stowed position (phantom lines in FIG. 3)

In the support position, the ballast 160 bears on the top of the stack 52, i.e., on the card 50 which is the highest, and in the stowed position, the ballast 160 is on one side of stack 52, herein at the front of the stack 52, without pressing on the stack 52. The support position of the ballast 160 varies according to the number of remaining cards 50.

Thus, in the support position, the ballast 160 is in the reservoir 156 and, in the stowed position, it is outside the reservoir 156. Between the support position and the stowed position, the ballast 160 passes through the bottom wall 156*c* via a passage 166 that the bottom wall 156*c* has for this purpose above the window 164.

In the support position, the ballast 160 presses the cards 50 against the separation roll 158*a* to assist with the separation.

In the stowed position, the ballast 160 does not bear on the cards 50 and it is the cumulative weight of the cards 50 of the stack 52 which acts to press the cards 50 against the separation roll 158*a*.

According to a particular embodiment, the weight of the ballast 160 is equivalent to the weight of 15±3 cards.

The card feeder 150 also includes a transmission system 170 which is arranged so as to move the ballast 160 from the support position into the stowed position when the door 162 passes from the closed position into the open position. Thus, when a user opens the door 162, the ballast 160 passes into the stowed position to allow free access above the support 154*a* and the separation roll 158*a* in order to enable removal of a stack 52 of cards 50.

When the deposited stack 52 of cards 50 is relatively high, i.e., above the ballast 160, said ballast 160 remains stuck in the stowed position due to the fact that it bears against the side of the stack 52 (cf. the stowed position in FIG. 3), herein the front of the stack 52, and this support prevents it from returning back to the support position.

As the stack 52 decreases, the card 50 that is the highest in the stack 52 goes down. When this card 50 passes below the level of the ballast 160, said ballast 160 is then free to return back to its support position by bearing on said highest card 50 and following it as it descends.

Moreover, the transmission system 170 is not intended to bring the ballast 160 back to the support position, so as not to force the ballast 160 against the stack 52 when the door 162 passes from the open position into the closed position.

To ensure the return of the ballast 160 back to the support position, the card feeder 150 includes a return system 172 which is arranged so as to automatically return the ballast 160 back to the support position when it is in the stowed position. This return system 172 is different from the transmission system 170 so as not to link the return of the ballast 160 to closure of the door 162.

With such an arrangement, the ballast 160 assists in picking the cards 50 by the separation system 158, without hindering the placement of the cards 50 in the reservoir 156 and without forcing the ballast 160 against the stack 52.

In the embodiment of the invention shown in FIGS. 3 and 6, the ballast 160 is mounted movable in rotation about a tilting axis 160*a* directed according to a transverse direction, i.e. parallel to the axis 158*b* of the separation roll 158*a*.

In this case, the ballast 160 includes a weight 160*b* and two arms 160*c* which are secured to the weight 160*b* and where each is mounted movable in rotation about the tilting axis 160*a*.

The tilting axis 160*a* is arranged so that the center of gravity G of the ballast 160, i.e., herein of the weight 160*b* and of the arms 160*c*, is vertically above the tilting axis 160*a* and horizontally between the tilting axis 160*a* and the reservoir 156, and therefore the stack 52, when the ballast 160 is in the stowed position.

Thus, in this position, gravity tends to bring the ballast 160 back into the support position when the ballast 160 no longer bears against the stack 52. As the height of the stack 52 decreases, the pressure exerted by the ballast 160 will increase.

Thus, in this embodiment, the return system 172 is gravity which is exerted on the ballast 160 at its center of gravity G.

In another embodiment, a spring may be arranged so as to return the ballast 160 back to the support position when it is moved away.

In the embodiment of the invention described herein, the transmission system 170 includes a slider 174 which is mounted movable in translation on the frame 152 parallel to a direction of translation T perpendicular to the tilting axis 160*a*, and herein generally horizontal.

In the embodiment of the invention described herein, the translational movement is achieved by fastening the slider 174 on the frame 152 by two fastening screws 174*a* which are screwed into the frame 152 through oblong holes 174*b* that pass through the slider 174, and where the major axis of each oblong hole 174*b* is parallel to the direction of translation T.

Of course, it is possible to achieve this translational movement by other means, such as rails for example.

Moreover, the slider 174 is linked to the ballast 160 via a sliding pivot connection 176. To this end, the transmission system 170 includes a shaft 176*a* secured to the ballast 160 and a housing 176*b* which is formed in the slider 174.

The shaft 176*a* is herein parallel to the tilting axis 160*a* but offset with respect to the latter. Thus, any movement of the shaft 176*a* will drive the ballast 160 in rotation about the tilting axis 160*a* and vice versa.

The housing 176*b* is sized so as to prevent any movement parallel to the direction of translation T between the slider 174 and the shaft 176*a* and to authorize movements perpendicular to the direction of translation T, herein vertical movements, between the slider 174 and the shaft 176*a*.

Thus, as soon as the slider 174 moves according to the translation direction T, the shaft 176*a* is forced to move at the same time and, due to the rotation of the ballast 160 about the tilting axis 160*a*, the shaft 176*a* moves perpendicular to the direction of translation T in the housing 176*b*.

Conversely, as soon as the shaft 176*a* moves in rotation under the effect of the ballast 160, the slider 174 is forced to move at the same time according to the direction of translation T and the shaft 176*a* moves perpendicular to the direction of translation T in the housing 176*b*.

Thus, the slider 174 moves between a first position corresponding to the support position of the ballast 160 when there is no longer any card 50 in the reservoir 156 and a second position corresponding to the stowed position of the ballast 160.

The transmission system 170 also includes a cam 162*b* secured to the door 162 and which therefore moves with it during movement thereof between the open and closed positions.

The slider 174 includes a stop 174*c* which forms a follower element for the cam 162*b* when the latter moves from the closed position into the open position. Thus, the cam 162*b* and the stop 174*c* are arranged so that the stop 174*c* follows the cam 162*b* during movement thereof from the closed position into the open position and the slider 174 then passes from the first position (support position of the ballast 160) into the second position (stowed position of the ballast 160), but the stop 174*c* and therefore the slider 174 are not forced to follow the cam 162*b* during movement of the latter from the open position into the closed position.

The cam 162*b* is herein in the form of a circle arc coaxial with the door axis 162*a*, and the stop 174*c* is in the form of a wall of the slider 174*c*, where the wall is positioned so as to be pushed by the cam 162*b* during movement thereof from the closed position into the open position and so as to thus move the slider 174 from the first position into the second position.

The operation is then as follows from the closed position of the door 162 and from the support position of the ballast 160 and into the first position of the slider 174.

A user manipulates the door 162 to place it in the open position. The cooperation between the cam 162*b* and the stop 174*c* forces the slider 174 to move into the second position, and the cooperation between the housing 176*b* and the shaft 176*a* causes movement of the ballast 160 into its stowed position. The user can then deposit the cards 50 in the reservoir 156.

The user manipulates the door 162 to set it in the closed position. The cam 162*b* does not act on the stop 174*c* which therefore remains in the same position due to the fact that the ballast 160 is blocked by the stack 52. As the stack decreases, the ballast 160 will pivot about the tilting axis 160*a* while moving from the stowed position into the support position and while driving the shaft 176*a*, and, due to the cooperation of the shaft 176*a* with the housing 176*b*, the slider 174 will move towards its first position.

The invention claimed is:

1. A card feeder for a processing machine, the card feeder comprising:

a frame;

a reservoir at the base of which a tray is arranged, and above the tray, a support intended to receive a stack of cards;

a separation system including a separation roll arranged at a level of the tray and a drive system arranged so as to move the separation roll in rotation;

a ballast movably mounted on the frame between a support position in which the ballast bears on a top of the stack of cards and a stowed position in which the ballast is on one side of the stack of cards;

a door movably mounted on the frame between an open position enabling access to the reservoir and a closed position preventing access to the reservoir; and a transmission system arranged so as to move the ballast from the support position into the stowed position when the door passes from the closed position into the open position; and wherein the ballast is mounted movable in rotation about a tilting axis parallel to an axis of the separation roll, wherein the tilting axis is arranged so that a center of gravity of the ballast is vertically above the tilting axis and horizontally between the tilting axis and the reservoir when the ballast is in the stowed position, such that gravity brings the ballast back from the stowed position into the support position.

2. The card feeder according to claim 1, wherein the transmission system comprises:

a cam secured to the door and moveable therewith between the open position and the closed position;

a shaft secured to the ballast parallel to the tilting axis and offset with respect to the tilting axis; and a slider mounted movable in a direction of translation on the frame and including a stop forming a follower element for the cam, wherein the slider moves from a first position corresponding to the support position of the ballast into a second position corresponding to the stowed position of the ballast when the cam moves from the closed position into the open position, the slider having a housing in which the shaft is accommodated, wherein the housing is arranged so as to prevent any movement parallel to the direction of translation between the slider and the shaft and enable movement perpendicular to the direction of translation between the slider and the shaft.

3. A card processing machine comprising a card feeder according to claim 2, a processing module, and a transport system configured to move the cards from the card feeder to the processing module.

4. A card processing machine comprising a card feeder according to claim 1, a processing module, and a transport system including means for moving the cards from the card feeder to the processing module.

5. A card processing machine comprising a card feeder according to claim 1, a processing module, and a transport system configured to move the cards from the card feeder to the processing module.

* * * * *